US005156211A

United States Patent [19]

Wyatt

[11] Patent Number: 5,156,211

[45] Date of Patent: Oct. 20, 1992

[54] REMOTELY ADJUSTABLE FISHING JAR AND METHOD FOR USING SAME

[75] Inventor: Wilfred B. Wyatt, Houma, La.

[73] Assignee: Impact Selector, Inc., Houma, La.

[21] Appl. No.: 712,564

[22] Filed: Jun. 10, 1991

[51] Int. Cl.[5] ..... E21B 31/107

[52] U.S. Cl. ..... 166/301; 166/178

[58] Field of Search ..... 166/178, 301; 175/299, 175/300, 303, 304, 305

[56] References Cited

U.S. PATENT DOCUMENTS 3,658,598 8/1972 Nutter ..... 175/304 X
4,646,830 3/1987 Templeton ..... 166/178
4,919,219 4/1990 Taylor ..... 166/178 X
5,022,473 6/1991 Taylor ..... 166/178 X

*Primary Examiner*—Stephen J. Novosad
*Attorney, Agent, or Firm*—Michael D. Carbo

[57] ABSTRACT

A remotely-adjustable, downhole fishing jar of the mechanical type is used within a well bore for freeing stuck pipe or tools. The jar, while downhole, can be set or reset by an operator at the surface for each firing stroke for any desired impact force within the capability of the finishing string to apply tension to the jar. A selected amount of tension to the fishing string is applied by the operator to set in a mechanical memory of the jar the desired impact force.

2 Claims, 9 Drawing Sheets

REMOTELY ADJUSTABLE FISHING JAR AND METHOD FOR USING SAME

BACKGROUND OF THE INVENTION

The present invention relates generally to fishing apparatus used within a well bore to free stuck pipe or tools. More specifically, the invention relates to an advance in well jars of the mechanical type as exemplified by the tools disclosed in the prior art.

In clearing an object stuck downhole in an oil well, it is common practice to employ a catching or retrieving tool, either an overshot or a spear, to obtain a hold on the stuck object, known as a fish, and a jarring tool, known as a fishing jar, which is capable of delivering one or more jarring or impact forces to the stuck object in an effort to free it and remove it from the well bore. Designs of conventional fishing jars are of two basic types, hydraulic or mechanical. A principal difference between the two types is in the method of locking and releasing a mandrel to cause the jar to impact or fire. Both types have certain advantages and disadvantages.

A fishing jar of the hydraulic type usually has a mandrel with an attached sliding valve that fits closely in a restricted bore in an outer housing. When a jarring force is required, tension is applied to move the mandrel relative to the housing. This movement provides a temporary delay before the mandrel is released to produce a jarring force. By increasing or decreasing initial tension applied to a jar, the resulting jarring force may be varied to some extent. When a mandrel is released, the energy stored in the stretched pipe string or other operating string to which the fishing jar is connected accelerates the jar mandrel rapidly to its fully extended position against a stop. The stop converts kinetic energy of the rapidly moving mass of the pipe string into an intense jarring force which is transmitted through an overshot or a spear to a stuck object or fish. The jarring force developed is greater than the original static tension applied through the fishing string.

Hydraulic fishing jars have an advantage over mechanical fishing jars in the ability to vary the jarring force while the tool is downhole. However, due to design limitations, extremely high hydraulic pressures developed during the delay period in some jars cause premature seal failure, leaving the jar inoperative. Also, viscosity change in hydraulic fluid due to temperature increase while jarring reduces the delay period in some hydraulic jars to the point that the jar becomes useless.

Mechanical fishing jars utilize a mandrel to compress a series of disc springs, also known as belleville washers, instead of using trapped fluid, to restrain the movement of the mandrel relative to the housing. A latch mechanism is set at a predetermined position to release the mandrel when the disc springs have been compressed by the mandrel to that predetermined point. As in a hydraulic fishing jar, when a mandrel is released, energy stored in the stretched fishing string accelerates the jar mandrel rapidly to its fully extended position against a stop. This sudden stop converts the kinetic energy of the rapidly moving mass of the fishing string into an intense jarring force, which is transmitted to the stuck object or fish. Conventional mechanical jar designs typically require a jar to be brought to the surface to adjust the latch release point and thereby to increase or decrease the impact force delivered by the mandrel to the fishing jar body.

U.S Pat. No. 4,919,219 of Taylor discloses a repetitive cam arrangement that allows a jar to be adjusted While it is downhole. Adjustments range from a minimum setting, through a progression of increased settings, to a maximum setting by repetitive upward and downward movement of the fishing string. When impact adjustment reaches a maximum setting, the cam arrangement is programmed to return to its minimum set position. Any setting increment may be located by the operator by repetitive movement of the fishing string. The remotely adjustable fishing jar disclosed by Taylor does not allow a fishing jar to be used initially at its maximum jarring force. Also, the jar disclosed by Taylor does not allow readily for calculation of a maximum jarring force because of friction. Sometimes it is difficult to tell which setting is engaged. The proper jarring force may fall between settings, one of which is too low in force and the other of which will not allow the jar to fire. The jar setting could become out of synchronicity with a ratchet type overshot causing the overshot to release the fish.

Taylor discloses a single lug latch assembly and, therefore, that jar is limited in surface contact area. Taylor discloses compression of disk springs upwardly. When the latch assembly releases the disk springs, the energy released by the springs imparts a downward force on the jar, thereby reducing the net upward force communicated to the fish. An accelerator may be required to increase the net upward force to a useful amount.

Accordingly, it is an object of the invention to allow a fishing string operator to determine a desired jar impact force for each impact of the jar, all while operating at draw works above the surface.

It is a further object of the invention to provide a remotely adjustable fishing jar that can be reset for each firing stroke and for any desired impact force within the capability of the fishing string to apply tension to the jar, all while the jar is downhole and controlled through an operating string by an operator at the surface.

It is a further object of the invention to provide a fishing jar that eliminates the need for an accelerator.

It is a further object of the invention to provide an adjustable fishing jar that allows an operator to apply a selected amount of tension to a fishing string to set in a mechanical memory of the jar a desired impact force that ranges continuously over the range of tension that can be applied and, if the jarring force is not sufficient to free the fish, to allow the selection of another, higher impact force to be set into the mechanical memory of the fishing jar.

Another object of the invention is to provide a method for retrieving an object stuck within a well bore by 1 remotely selecting successive jarring impact forces for each firing stroke while the jar remains downhole, all without the necessity of repetitively sequencing through a predetermined cam array.

SUMMARY OF THE INVENTION

To achieve the foregoing and other objects and advantages of the invention, and in accordance with the purposes of the invention as broadly described herein, a remotely adjustable fishing jar apparatus comprises: (a) an operating mandrel reciprocatively mounted within a housing body with the mandrel and the body being adapted to be connected to a fishing operating string, the mandrel and the body forming an impact hammer and an impact anvil for creating an upwardly directed impact force, (b) an impact release spring adapted to be compressed between the mandrel and the body responsive to tension applied to the operating string, (c) the mechanical memory mechanism for retaining an amount of overlap between an outer latch body and a relatively rotatable inner latch body during operator selection of tensional force in the operating string; and (d) releasable latching means connected between the mandrel and a bottom portion of the housing body for compressing the release spring downward a designated distance with a designated movement of the mandrel until the latching means is released when moved past a release position set by the mechanical memory mechanism, the sudden release of the impact release spring translating to sudden upward movement of the mandrel responsive to the tensional force of the operating string and resulting in impact of the hammer with the anvil. Multiple lobes on the inner latch body are positioned to fit into matching recesses in the outer latch body. The latch mechanism allows for selectively varying the amount of overlap between the outer and inner latch bodies. The amount of overlap between the outer and inner latch bodies is retained in a mechanical memory by the positioning of a latch return sleeve. The amount of overlap retained in memory corresponds to the amount of tensional force selected and applied by an operator. This is called the pre-set tensional force. When the pre-set tensional force is released and then tensional force exceeding the pre-set tensional force is applied, the latch releases and the jar fires.

To achieve the foregoing and other objects and advantages of the invention, and in accordance with the purposes of the invention as broadly described herein, a method for retrieving objects stuck within a well bore comprises the steps of: (1) aligning a plurality of lobes on an inner latch body with recesses in an outer latch body of a remotely adjustable fishing jar so that the lobes align with the recesses in an initial overlap position; (2) increasing tension on an operating string, thereby increasing the overlap of the lobes into the recesses in relation to the amount of tensional force applied to an operating string; (3) retaining in a mechanical memory the maximum overlap attained; (4) firing the jar by decreasing overlap between the latch bodies to release the lobes from their recesses, thus permitting rapid acceleration of the jar mandrel to its fully extended position against a stop on the housing of a fishing jar mechanism; and (4) reinitialization of the latch mechanism by releasing all tension on the fishing string to allow for alignment of lobes into recesses in another initial overlap position.

BRIEF DESCRIPTION OF DRAWINGS

A greater appreciation of the objects and advantages of the invention may be understood by the below set forth description taking in conjunction with the drawings, wherein:

FIG. 2(*b*) is a sectional view of the lower portion of the fishing jar mechanism of FIG. 1.

DESCRIPTION OF PREFERRED EMBODIMENT

Figure 1:
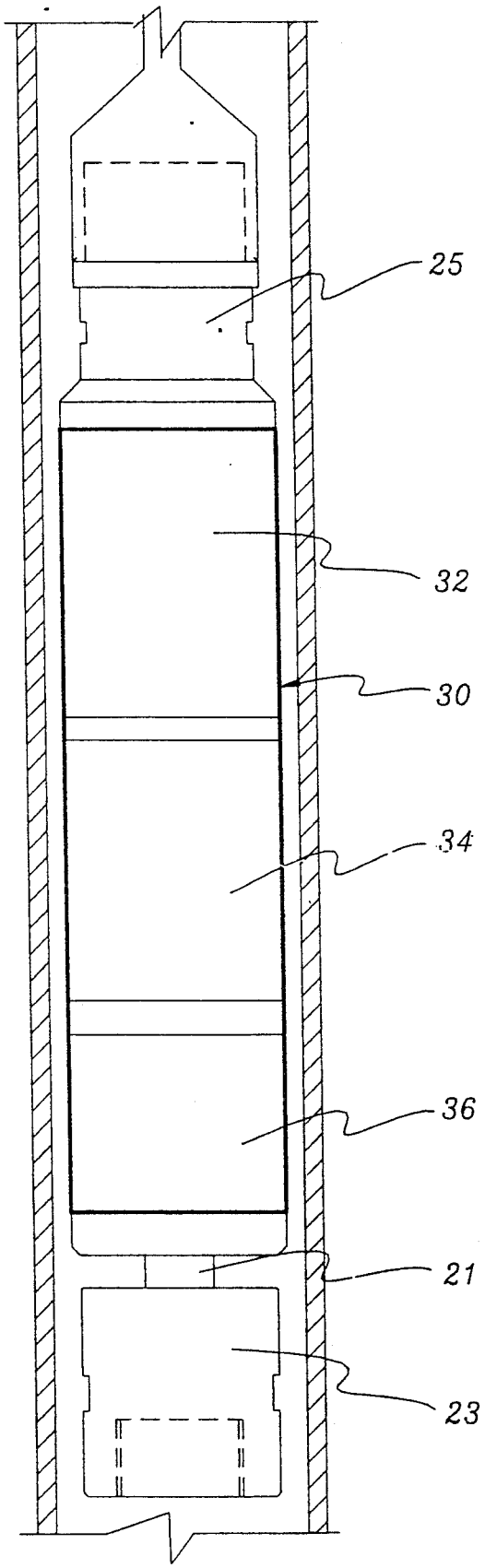
FIG. 1 is an elevational view of a downhole fishing jar mechanism according to the invention, showing the mechanism as being positioned within a well casing and being interconnected with a fishing tool, illustrated in broken line.
Figure 2A:
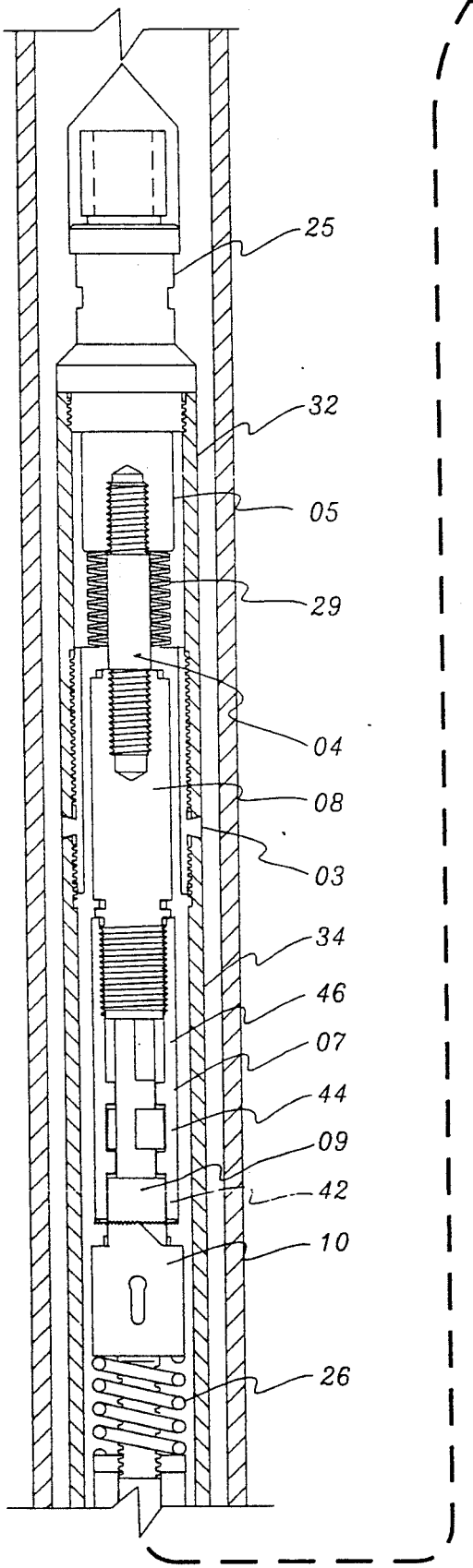
FIG. 2(*a*) is a sectional view of the upper portion of the downhole fishing jar mechanism of FIG. 1, showing mandrel and spring components.
Figure 2B:
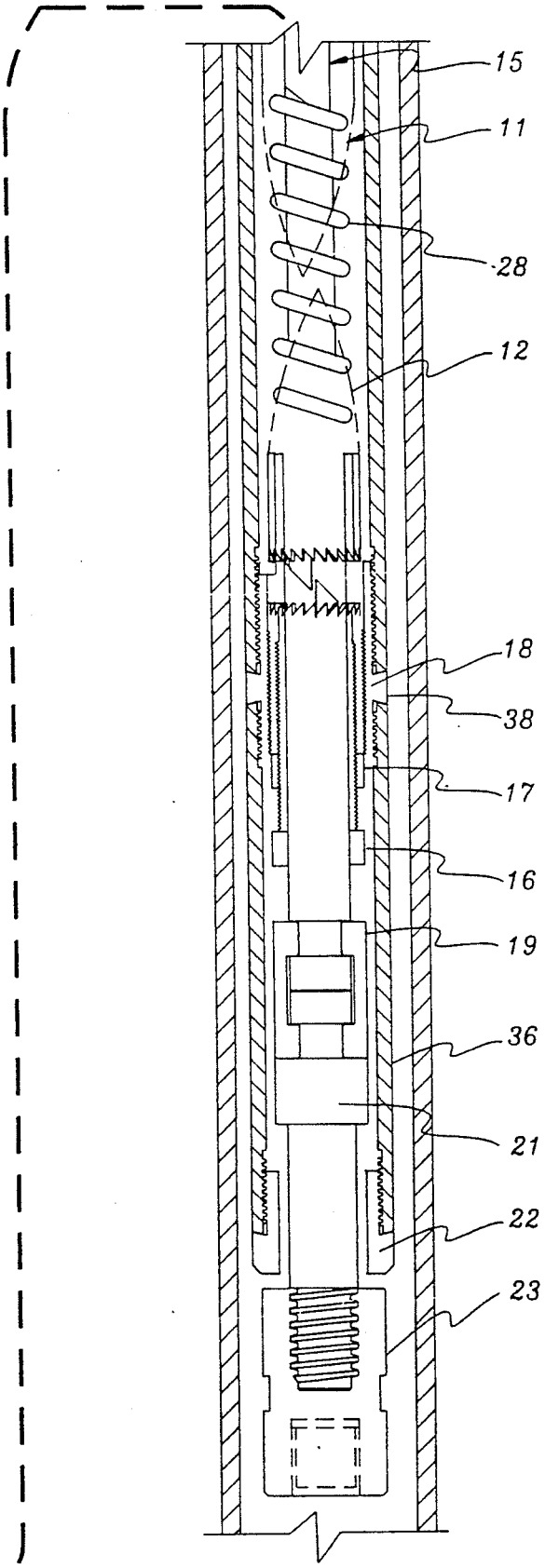

As an initial general description of the jar tool as shown in FIGS. 1, 2(*a*) and 2(*b*), tool 1 can be manufactured in several sizes. For example, tool 1 may be provided from 1 9/16 inch outer diameter to 3 inch outer diameter, or greater, for operation from a wire line as the operating string. With well tubing or drill pipe as the operating string, tool 1 can be provided in several sizes ranging from 3 inch outer diameter to 9 inch outer diameter, or greater.

Tool 1, as shown in FIG. 1, is capable of being connected at top sub 25 to an upper operating string, and is capable of being connected through bottom sub 23, through an overshot or a spear, to a stuck object, commonly known as a fish.

Tool 1 extends in length responsive to tensional force applied to the operating string from draw works on the earth's surface. The operating string as a whole also stretches along its length. While tool 1 is being extended in length by a tensional force, upper release spring 29 is compressed accordingly and stores energy corresponding to the operating string stretch force. A releasing latch assembly comprising outer latch 7, latch extension 8 connected to mandrel 4, and also comprising inner latch 9 having axially spaced lobes disposed circumferentially around a central shaft, and adapted for engagement into recesses axially disposed along outer latch 7. Impact hammer 5 is connected to mandrel 4 and is adapted to strike top sub 25, sub 25 forming an upper portion of housing 30, as the releasing latch assembly unlatches, thereby releasing spring 29 from compression.

Tensional force in the operating string pulls housing 30 upwardly and causes bottom sub shaft 21 to extend out of housing 30. The tensional force of the operation string and the force generated by suddenly releasing spring 29 from compression rapidly push mandrel 4 and attached hammer 5 into impact with top sub 25 to create an upwardly jarring impact force communicated through tool 1 to the fish.

Housing 30 contains upper body 32, middle body 34, and lower body 36. First body connector 3 connects upper body 32 and middle body 34. Second body connector 18 connects middle body 34 and lower body 36 Second body connector 18 is a tube having inner and outer circumferential threads, the upper and lower outer threads being adapted for screw connection into middle body 34 and lower body 36, respectively, to couple rigidly bodies 34 and 36. Second body connector 18 also comprises shoulder 38 which separates upper outer threads and lower outer threads to allow middle body 34 and lower body 36 to tighten against shoulder 38 without directly contacting each other. Second body connector 18 also contains inner threads extending the length of the tube for receiving adjusting unit 16. The upper end of second body connector 18 has teeth extending longitudinally upward and adapted for engagement with teeth on the lower end of rotational guide 12.

First body connector 3 is substantially the same as second body connector 18, except first body connector 3 has no internal threads and no teeth, and first body connector 3 has splines extending longitudinally internally for accepting splines on latch extension 8.

Upper body 32 contains top sub 25, mandrel shaft 4 and a plurality of disc springs 29 (also known as belleville washers). Top sub 25 screws into an upper portion of upper body 32. Top sub 25 connects upper body 32 to an operating string. Top sub 25 provides a fishing neck to allow it to be grasped by an overshot when an operating string is disconnected from top sub 25.

Mandrel shaft 4 is a hardened steel shaft having lower threads for connection with latch body extension 8. Mandrel shaft 4 has upper threads for connection to hammer 5, also called a disc spring cap. Disc springs 29, comprising a plurality of belleville washers, slide over mandrel shaft 4 and are compressed between first body connector 3 and hammer 5 as body housing 30 is drawn up by tension in an operating string while mandrel shaft 4 remains relatively stationary because it is indirectly attached to a stationary fish.

Middle body 34 contains outer latch 7, latch extension 8, inner latch 9, latch sleeve 10, one way guide 11, sleeve spring 26, main shaft 15, return spring 28, rotational guide 12, adjusting unit 16, and lock nut 17. Latch extension 8 screws into outer latch 7 and receives a lower threaded portion of mandrel 4. Outer latch 7 receives the lower threaded portion of latch extension 8, and also receives inner latch 9.

Outer latch 7 contains lower portion 42, middle portion 44, and upper portion 46. Lower portion 42 is tubular and has longitudinally downward projecting teeth disposed along the entire circumference. Two teeth, 180 degrees apart extend further longitudinally than the other teeth.

Middle portion 44 of outer latch 7 defines a tube each other. Each cut-out extends 40 degrees circumferentially at an upper end to 110 degrees circumferentially at a lower end. Each cut-out defines one face parallel to the central axis of the tube of outer latch 7. A second face defined by each cut-out is curved. Radially, each second face defined by the cut-out portion of outer latch 7 is perpendicular to the central axis of the tube. Longitudinally, one cut-out face is parallel to the central axis of the tube and the other cut-out face curves to allow for a 40 degree to 110 degree opening extending from the upper to lower portions of outer latch 7.

Upper portion 46 of outer latch 7 forms an internally threaded tube for receiving mating threads of latch extension 8.

Inner latch 9 comprises a shaft having upper and lower portions, the upper portion having a plurality of pairs of lobes, one lobe of each pair being located 180 degrees apart from the other lobe of the pair, and one lobe of each pair being identical to the other lobe of the pair. Each lobe in an upper position is 20 degrees wide at its uppermost part. Each lobe in a lower position is 70 degrees wide at its lowermost part. All lobes are matched to fit simultaneously into recessed areas of outer latch 7. A lower portion of the shaft of inner latch 9 is larger in diameter than the upper portion of the shaft. The lower portion of the shaft is adapted to receive in longitudinally sliding engagement latch sleeve 10, and is also adapted to receive latch sleeve spring 26. The lower portion of the shaft of inner latch 9 has a shoulder, comprising a ring of larger diameter than the lower portion of the shaft, for engaging latch sleeve spring 26 in contact with the lower end of latch sleeve 10 and for biasing latch sleeve teeth against outer latch teeth.

The lower portion of the shaft of inner latch 9 has internal threads for receiving main shaft 15. Inner latch 9 contains a pin protruding radially outward from the lower portion of the shaft of inner latch 9, and protruding into a slot on latch sleeve 10. Preferably, two pins are used to distribute evenly any twisting load.

As inner latch 9 is unlatched from outer latch 7 and outer latch 7 is moved longitudinally upward relative to inner latch 9 so that the latches increasingly separate, inner latch 9 is rotated as a result of progressive engagement of one way guide 11 and rotational guide 12. The cut-out portions are required to allow inner latch 9 and associated lobes to rotate relative to outer latch 7 and associated recesses, and also to allow the latches to separate as outer latch 7 is withdrawn from inner latch 9.

As outer latch 7 is lowered onto inner latch 9, the longitudinally curved face of outer latch 7 guides the lobes on inner latch 9 into proximity with recesses in the curved faces parallel to the central axis so that when teeth on latch sleeve 10 engage the two longer teeth on outer latch 7, the lobes abut the parallel faces. As the teeth continue to engage during compression of sleeve spring 26, the lobes are forced into the recesses in outer latch 9 by rotation of latch sleeve 10, which is able to move longitudinally relative to main shaft 15 but which is prevented from rotating relative to main shaft 15.

Sleeve spring 26 forces latch sleeve 10 longitudinally against the inclined surface of the longer teeth on outer latch 7 and forces inner latch 9 to rotate its lobes into the recesses of outer latch 7. The lobes rotate into the recesses by 10 degrees before the shorter teeth on latch sleeve 10 engage the shorter teeth on outer latch 7. As tension is increased on an operating string, engagement of one way guide 11 and rotational guide 12 cause rotation (ratcheting) of latch sleeve 10 and outer latch 7, causing an increase in the degree of overlap between the latch lobes and the latch recesses. When tension is released on the operating string, the engagement of the teeth of outer latch 7 and the teeth of latch sleeve 10 cause the degree of overlap, corresponding to maximum tensional force applied, to remain as a mechanical memory.

Latch sleeve 10 is an annular sleeve having two longitudinal slots, each slot being displaced 180 degrees from the other slot. Latch sleeve 10 is capable of longitudinal movement relative to the shaft of inner latch 9. An upper portion of latch sleeve 10 has two sets of teeth, each set displaced 180 degrees from the other set, and each set projecting longitudinally upward from a base, the base extending longitudinally upward sufficiently far to allow engagement of latch sleeve teeth with outer latch teeth when the lobes on inner latch 9 align with recessed areas in outer latch 7.

Sleeve spring 26 is a coiled spring placed on the shaft of inner latch 9 and biased against latch sleeve 10 by the inner latch shoulder.

One way guide 11 is used as a memory positioner. One way guide 11 comprises an outer cylinder having a tapering substantially triangular projection projecting longitudinally downward and tapering to a point 90 degrees from the beginning of each taper. One way guide 11 also comprises an inner cylinder fixed to the outer cylinder and having a projection 180 degrees in width, the inner cylinder shaped to engage a main shaft projection to prevent rotational movement of one way guide 11 relative to main shaft 15.

Main shaft 15 is a cylindrical shaft having an upper threaded portion 50, a middle cylindrical portion 51, and a lower cylindrical portion 52. The middle cylindrical portion 51 has a diameter greater than the diameter of the upper portion, the upper end of the middle portion being adapted for engaging the inner cylindrical projection of one way guide 11 to hold one way guide 11 against a shoulder of inner latch 9 and to prevent one way guide 11 from moving, either longitudinally or rotationally, relative to main shaft 15, that is, to hold one way guide 11 fixedly against inner latch 9.

Lower cylindrical portion of main shaft 15 has a diameter greater than the middle cylindrical portion of main shaft 15, and has a circumferential groove 53 near the lower end of shaft 15, for engagement with shaft connector 9, and has an upward projection 54 adapted for engagement with memory guide 13 to rotationally reposition rotational guide 12 on main shaft 15. Memory guide 13 forms a portion of rotational guide 12.

Return spring 28, also called a guide spring, comprises a coiled spring that wraps around main shaft 15 between rotational guide 12 and one way guide 11 for biasing the teeth of rotational guide 12 against the teeth of body connector !8 as the jar tool is opened during the first one and one quarter inch of travel of the body upward relative to main shaft 15. As the jar closes, the lower cylindrical portion of main shaft 15 engages memory guide 13 to rotationally reposition memory guide 13 on main shaft 15 to realign rotational guide 12 with main shaft 15. Return spring 28 biases memory guide 13 against the rotational guide portion of main shaft 15.

Rotational guide 12, also called a two way guide, comprises an outer cylinder, a middle cylinder, and inner cylinder. The outer cylinder has a tapering, substantially triangular projection projecting upward and tapering to a point 90 degrees from the beginning of each taper, the lower end of the outer cylinder having teeth projecting longitudinally downward for engagement with teeth on the upper end of body connector 18.

Middle cylinder 14, also called a repositioning unit, is fixed to the interior of the outer cylinder of rotational guide 12. Middle cylinder 14 has a pointed projection extending downwardly from its lower end, the projection adapted for sliding engagement with an upward projection of adjusting unit 16 for repositioning rotational guide !2 at the beginning of an impact selection stroke.

Inner cylinder 13, also called a memory guide, is fixed to the interior of middle cylinder 14 forming a truncated right circular cylinder for engagement with the lower cylindrical portion of main shaft 15 to reposition rotational guide 12 when the jar closes at the end of each stroke.

The combined width of repositioning unit 14 and the projection of adjusting unit 16, minus the relative overlap of the units, establishes the variation between tensional force selected and the tensional force required to fire the jar. This variation is adjustable at the surface, thus making the jar remotely adjustable.

Adjusting unit 16 comprises a cylinder having external threads for screwing into body connector 18 and has a pointed projection extending upwardly from its upper end, the projection being adapted for sliding engagement with middle cylinder 14 of rotational guide 12. The lower end of adjusting unit 16 form polygonal wrench flats for receiving a wrench to rotationally adjust the position of adjusting unit 16 relative to repositioning unit 14.

Lock nut 17 is for locking the relative rotational position of adjusting unit 16 and body connector 18.

Lower body 36 comprises shaft connector 19, sub shaft 21, and bottom stop 22. Shaft oonnector 19 couples main shaft 15 with sub shaft 21. Shaft connector 19 forms a cylinder having a central longitudinal cavity, the diameter of the interior of the cavity being adapted for receiving the upper end of sub shaft 21 and the lower end of main shaft 15. Preferably, shaft connector 19 is formed in two pieces which, when mated around the upper end of sub shaft 21 and the lower end of main shaft 15, prevents relative longitudinal movement of main shaft 15 and sub shaft 21 while permitting main shaft 15 to rotate freely relative to sub shaft 21. Shaft connector 19 is adapted for longitudinal reciprocation within lower body 36.

Sub shaft 21 is a cylindrical shaft having an upper cylindrical portion having a diameter greater than a middle cylindrical portion and having a circumferential groove near the upper end of the cylindrical shaft. Sub shaft 21 also has a middle cylindrical portion, and also has a lower threaded portion for screwing into bottom sub 23. Bottom stop 22 forms a tube having outer threads and a shoulder portion. The outer threads are adapted for screwing bottom stop 22 into lower body 20. Bottom stop 22 is adapted for receiving bottom sub shaft 21.

Bottom sub 23 is a solid body having inner threads on an upper end to receive sub shaft 21 and having inner threads on a lower end for connection to a catching tool, either an overshot or a spear.

OPERATION OF PREFERRED EMBODIMENT

Referring now to FIG. 2, tool 1 is shown in cocked position in FIG. 2 for delivering a jarring or impact force to a fish through bottom sub 21 in response to tensional force applied through an operating string. Top sub 25 is moved upward to separate top sub 25 from hammer 5.

Figures 3A, 3B, 3C, 3D, 3E:
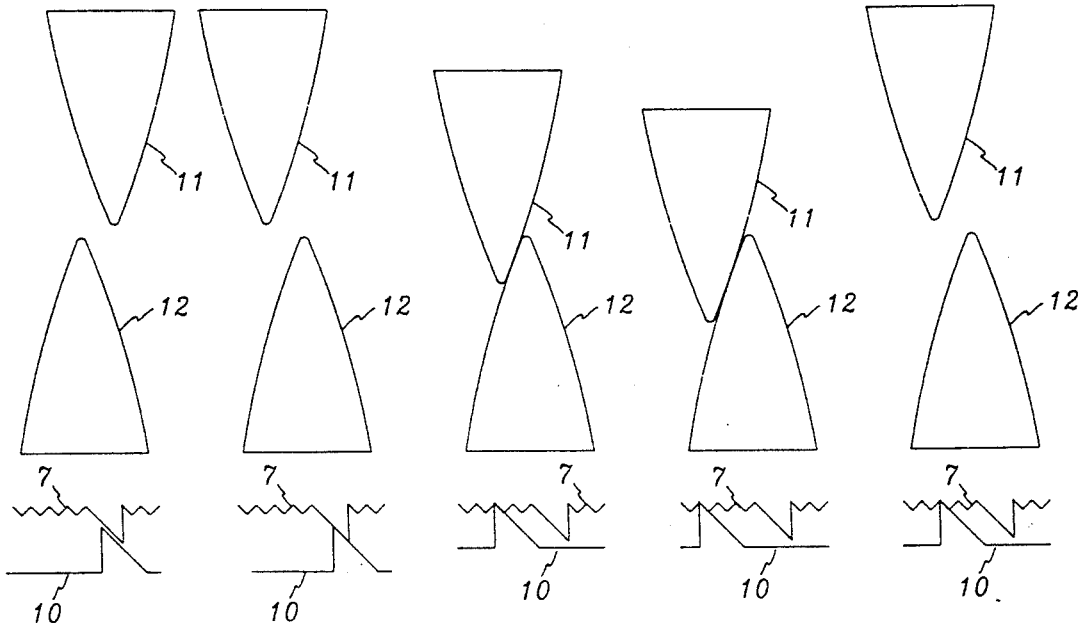
FIGS. 3(*a*) through 3(*j*) show in schematic representation successive relative positions of a rotational guide and a one way guide and of corresponding successive relative positions of latch sleeve teeth and outer latch teeth during selection and setting of an impact force.
Figures 3F, 3G, 3H, 3I, 3J:
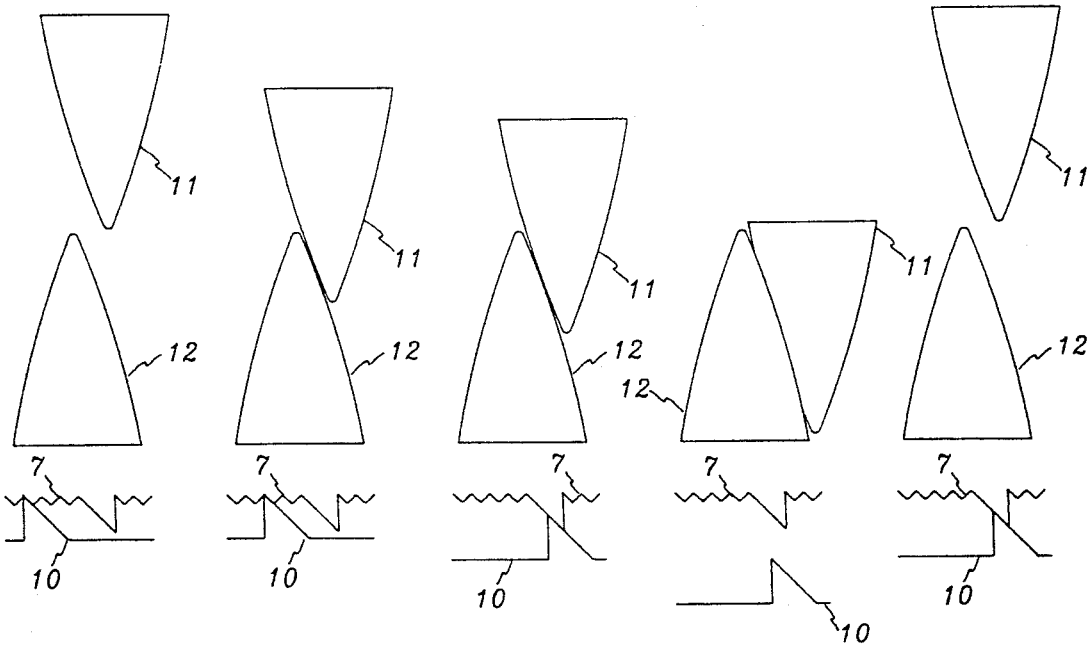
Figures 4A, 4B, 4C:
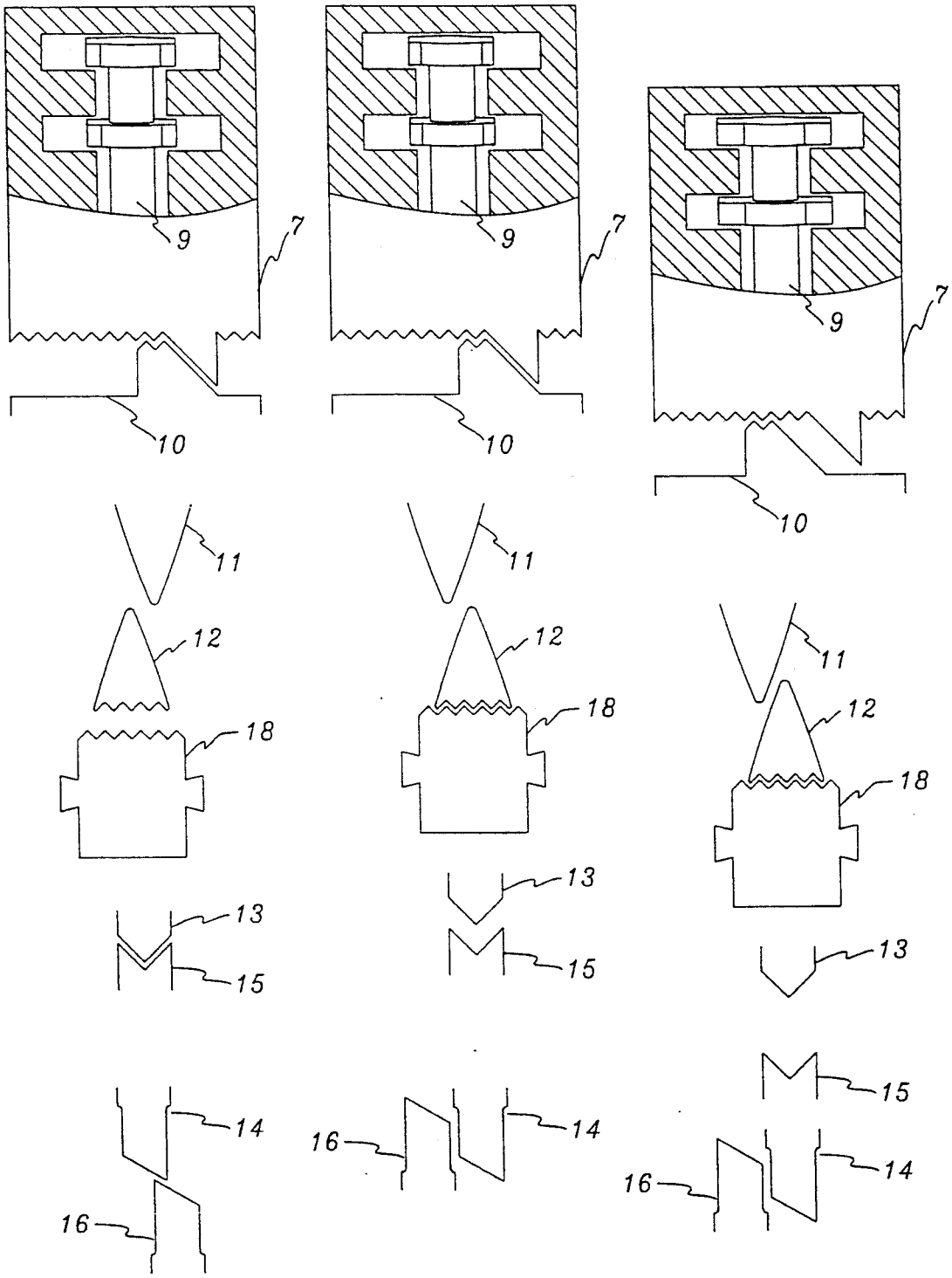
FIGS. 4(*a*) through 4(*l*) show in schematic representation the relative positions of components of the jar tool at selected times during jar operation.
Figure 4D:
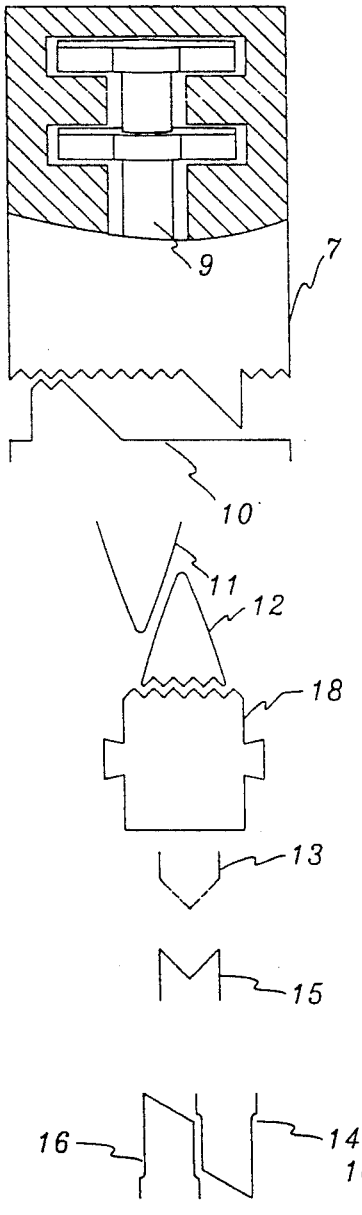
Figure 4E:
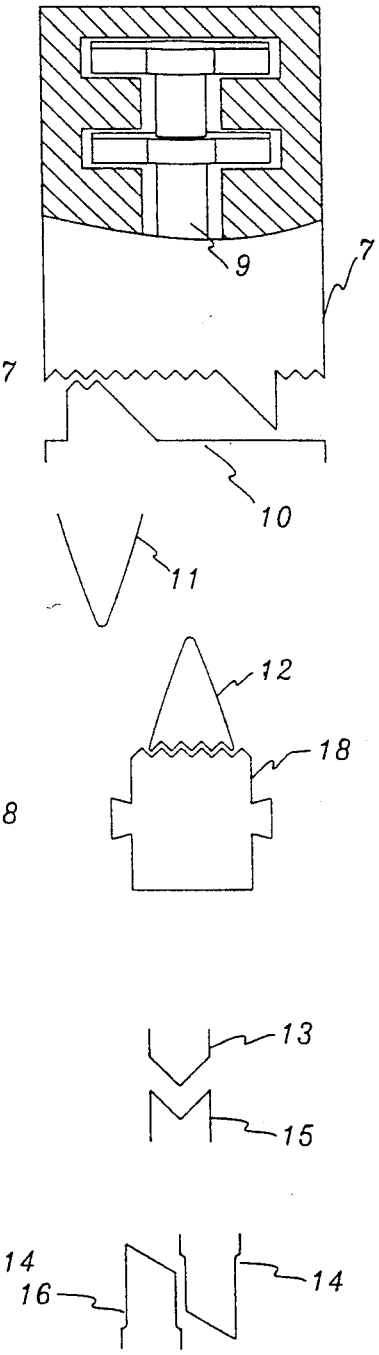
Figure 4F:
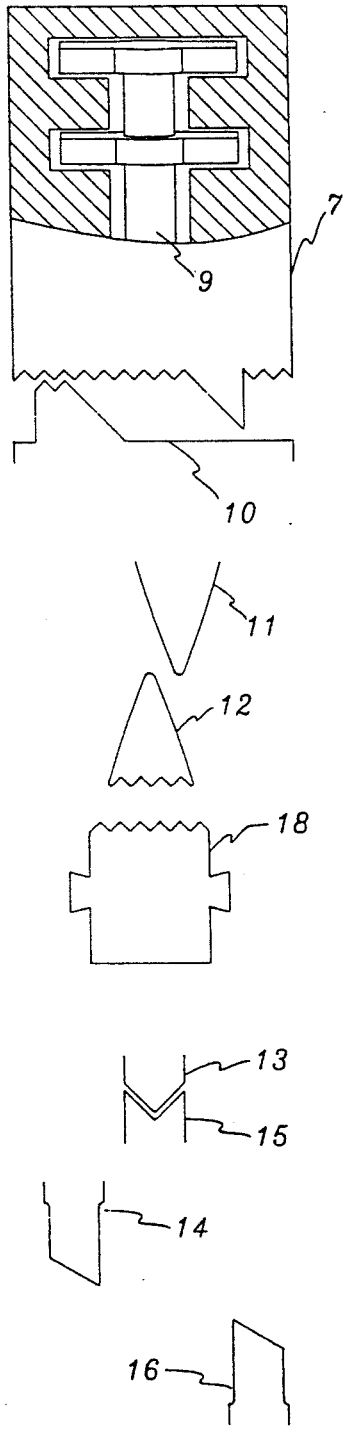
Figure 4G:
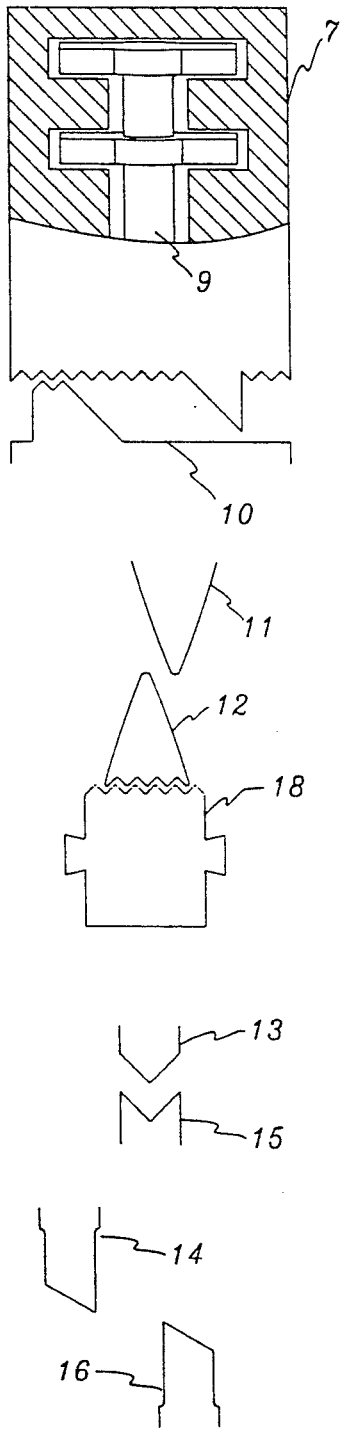
Figure 4H:
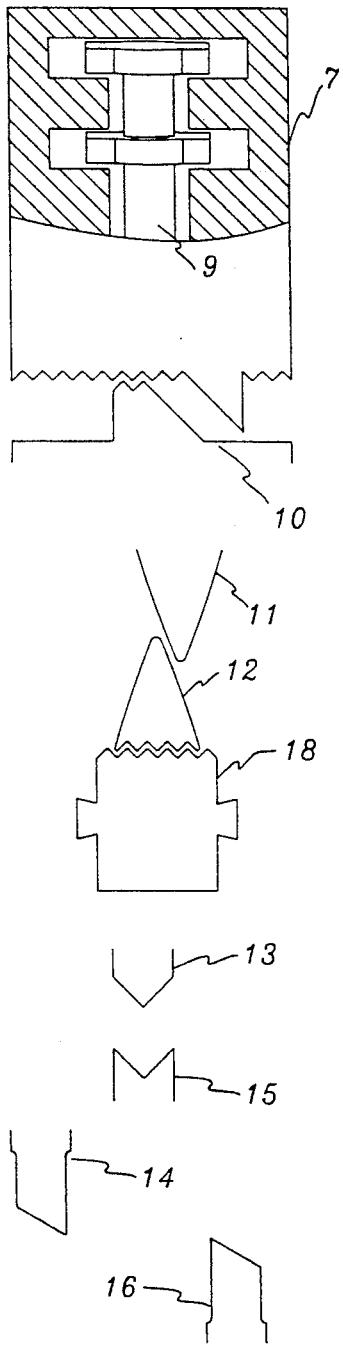
Figure 4I:
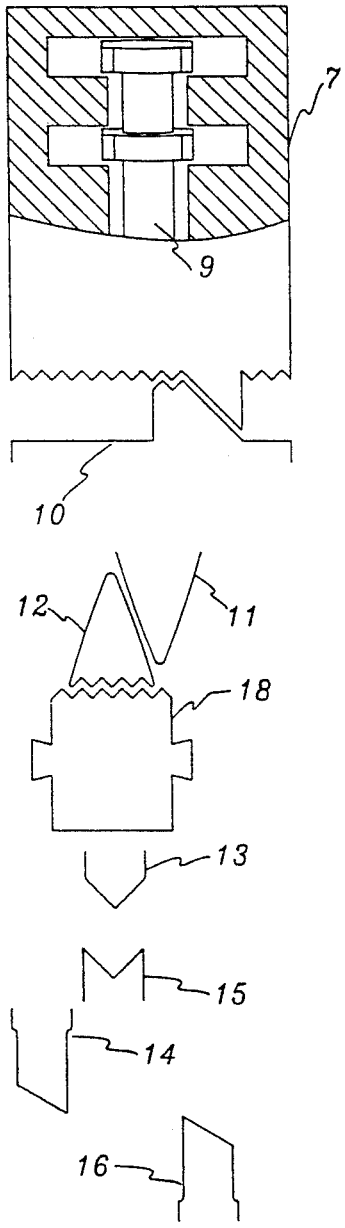
Figure 4J:
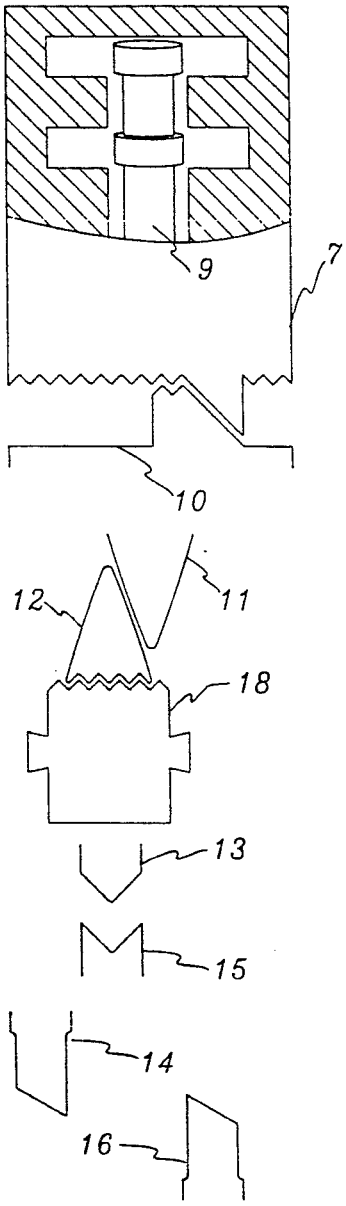
Figure 4K:
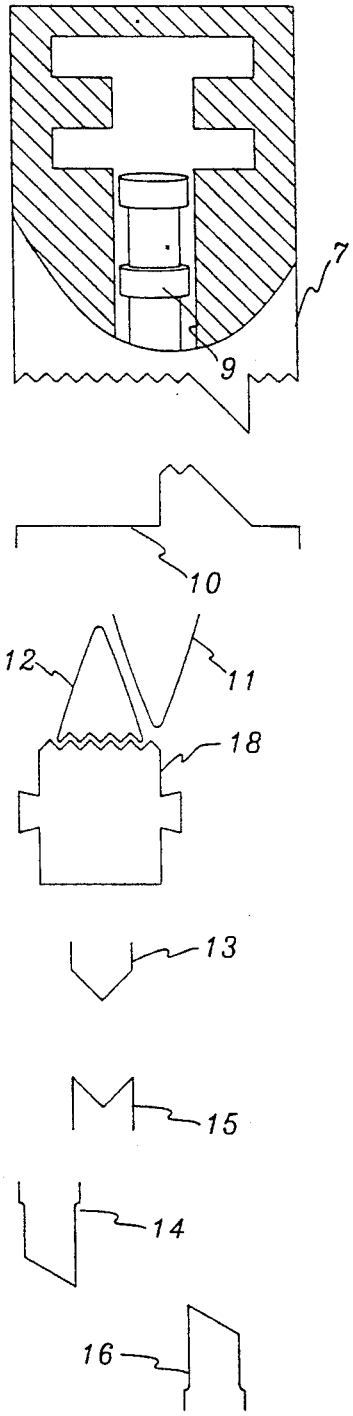
Figure 4L:
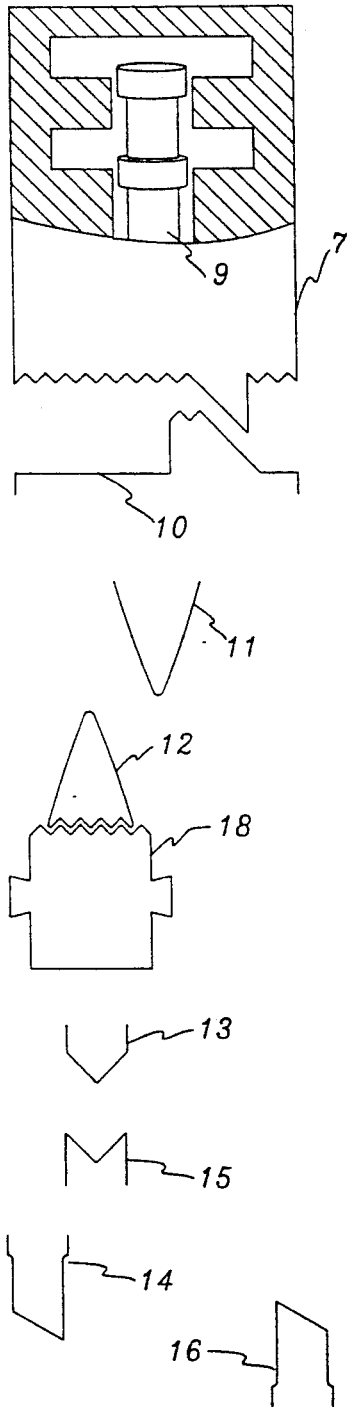
Figure 5A:
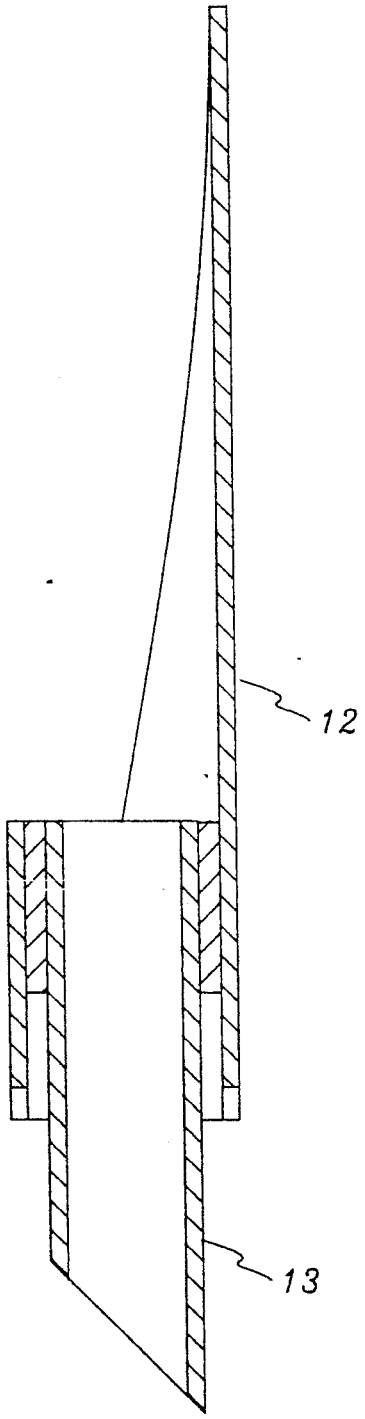
FIGS. 5(*a*) and 5(*b*) are sectional views of a rotational guide, FIG. 5(*b*) being axially rotated 90° with respect to FIG. 5(*a*), FIG. 5(*a*) showing a rotational guide and associated memory guide and FIG. 5(*b*) showing a rotational guide and associated repositioning unit.
Figure 5B:
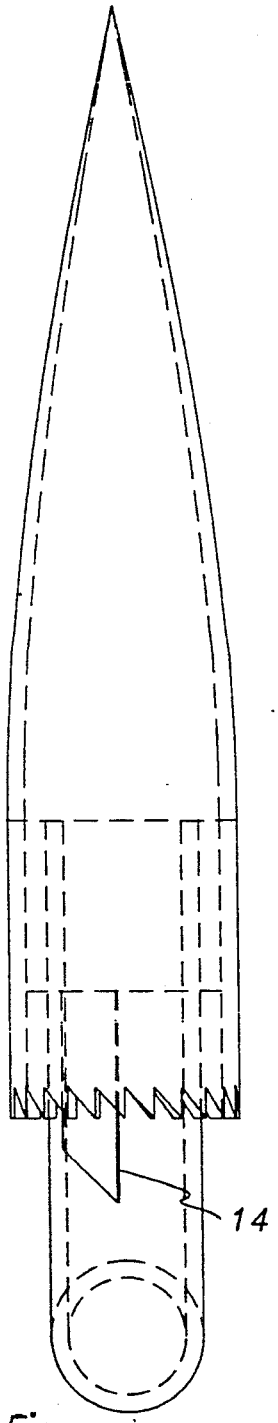
Figure 6A:
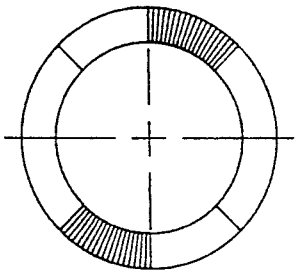
FIGS. 6(*a*) and 6(*b*) show top and side views, respectively, of a latch sleeve, FIG. 6(*a*) showing two sets of teeth, each set displaced 180 degrees from the other set.
Figure 6B:
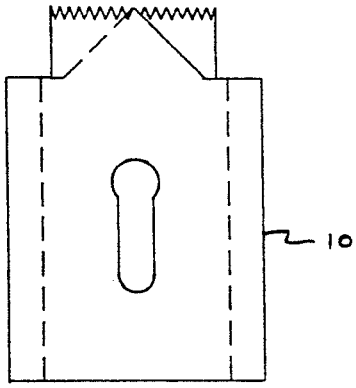
Figure 7:
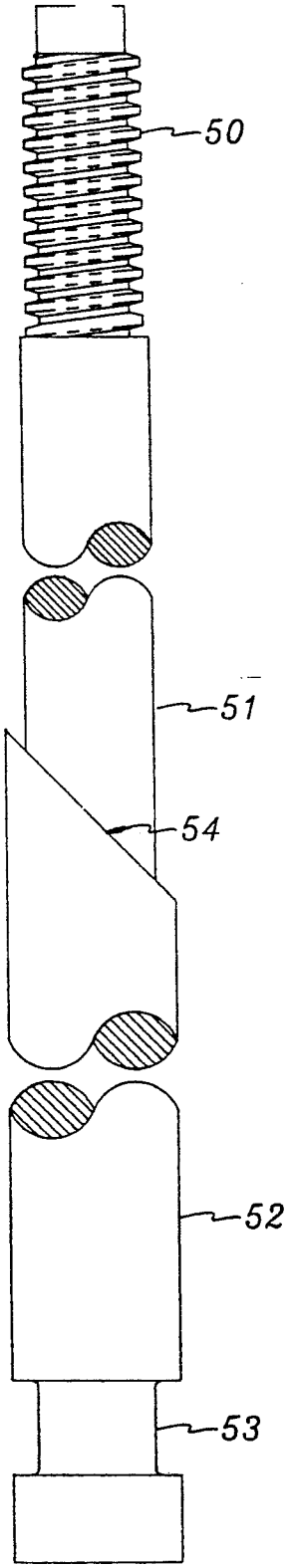
FIG. 7 shows a broken away elevational view of a main shaft showing the relative diameters of the upper, middle and lower portions of the main shaft and the associated projections and grooves thereof.

During selection of impact force, the lobes of inner latch 9 overlap the recesses of outer latch 7 by ten degrees. Rotational guide 12 and attached memory guide 13 have been moved upward by the lower cylindrical portion of main shaft (15) during the last one inch of travel in a prior jar closing cycle so that the gear face (i.e., teeth) of rotational guide 12 is no longer in contact with or locked to the gear face (i.e., teeth) of body connector 18. Memory positioner 11 is not in contact with rotational guide 12, as shown in FIG. 3 (*a*). The center line of rotational guide 12 is offset five degrees in a counter-clockwise direction from the center line of memory positioner 11 (orientation is looking upward from the bottom sub). Return spring 28 is slightly compressed between memory positioner 11 and rotational guide 12. During the jar opening part of impact selection, inner latch 9, memory positioner 11, rotational guide 12, memory guide 13, and outer latch 7 all move in unison downward. As repositioning unit 14 comes into contact with the upwardly protruding inclined part of latch adjusting unit 16, rotational guide 12 is forced to rotate ten degrees in a clockwise direction (orientation is looking upward from the bottom sub). The center line of rotational guide 12 thus becoming offset by five degrees in a clockwise direction relative to the center line of one way guide 11, as shown in FIG. 3(*b*). As the jar continues to open, the gear face of rotational guide 12 mates with and locks to the splined face of body connector 18 so that rotational guide 12 cannot be rotated in either direction and cannot move downward any farther. As the jar continues to open, memory positioner 11 makes contact with the inclined surface of rotational guide 12, as shown in FIG. 3(*c*), and memory positioner 11 rotates in a counter-clockwise direction at the rate of thirty degrees for each inch of travel as the jar continues to open, as shown in FIG. 3(*d*).

Because memory positioner 11 is attached to inner latch 9, inner latch 9 also rotates in a counter-clockwise direction at the rate of thirty degrees for each inch of travel as the jar continues to open, thus increasing the overlap of inner latch 9 within outer latch 7. After rotational guide 12 mates and locks to body connector 18, rotational guide 12 can no longer move downward as the jar opens, the lower cylindrical portion of main shaft 15, continues to move downward as the jar continues to open, and separates from its mated position with memory guide 13. Rotational guide 12 continues to be held in place against body connector 18 by pressure from return spring 28, which continues to be compressed by memory positioner 11.

During jar closing part of impact selection, as the jar closes, memory positioner 11 moves upward and disconnects from rotational guide 12, as shown in FIG. 3(*e*). However, the maximum amount of overlap attained during jar opening between inner latch 9 and outer latch 7 is maintained as a "memory" as a result of spring pressured latch sleeve 10 acting against the gear face of outer latch 7, which maintains relative position between outer latch 7 and inner latch 9.

As main shaft 15 continues to move upward during jar closing, the lower cylindrical portion of main shaft 15, engages memory guide 13, attached to rotational guide 12, thus forcing rotational guide 12 to move upward and to separate from locking connection with body connector 18.

Immediately as rotational guide 12 separates from its locking connection with body connector 18, the lower cylindrical portion of main shaft 15 forces memory guide 13 to rotate in a counter-clockwise direction until the lower cylindrical portion of main shaft 15 mates with memory guide 13. Immediately as the lower cylindrical portion of main shaft 15 and memory guide 13 are in a mated position, the center line of rotational guide 12 is offset five degrees in counter-clockwise direction from the center line of memory positioner 11, as shown in FIG. 3(*f*).

During jar opening of the impact cycle, pressure from return spring 28 acts against memory guide 13 to cause the gear face of rotational guide 12 to mate with and lock to the face of body connector 18 so that rotational guide 12 cannot be rotated in either direction and cannot move downward any farther. As the jar continues to open, memory positioner 11 makes contact with the inclined surface of rotational guide 12, as shown in FIG. 3(*g*), and is forced to rotate in a clockwise direction, as shown in FIG. 3(*h*). During the first inch of travel after contact between memory positioner 11 and rotational guide 12, as the jar continues to open, memory positioner 11 is forced to rotate a total of thirty degrees in a clockwise direction during the first inch of jar opening after contact.

As the jar continues to open after the first inch of jar opening after contact, memory positioner 11 rotates at thirty degrees per inch of jar opening until such time as the overlap between outer latch 7 and inner latch 9 reaches zero overlap, at which time the latch opens or fires and outer latch 24 moves upward rapidly to its fully extended position, thus driving the jar body rapidly up until shaft connector 19 impacts against bottom stop 22, which in turn transfers the full upward impact through bottom sub 23 directly to the stuck object or fish. The relative position of rotational guide 12 and memory positioner 11 immediately after firing is as shown in FIG. 3(*i*).

During the jar closing portion of the impact cycle, as the jar closes, inner latch 9 moves upward inside outer latch 7 until the top of inner latch 9 contacts the body of outer latch 7, thereby causing latch sleeve 10 to rotate inner latch 9 ten degrees in a counter-clockwise direction inside outer latch 7. As the jar closes memory positioner 11 moves upward and is no longer in contact with rotational guide 12, as shown in FIG. 3(*i*). As main shaft 15 moves upward during jar closing, the lower cylindrical portion of main shaft 15 engages memory guide 13 forcing rotational guide 12 to move upward against spring 28 and to separate from the locking connection with body connector 18.

Immediately as rotational guide 12 separates from its locking connection with body connector 18, the lower cylindrical portion of main shaft 15 forces memory guide 13 to rotate in a clockwise direction until the lower cylindrical portion of main shaft 15 mates with memory guide 13. Immediately as the lower cylindrical portion of main shaft 15 and memory guide 13 are in a mated position, the center line of rotational guide 12 is offset five degrees in a counter-clockwise direction from the center line of memory positioner 11, as shown in FIGS. 3(*a*).

Referring to FIGS. 4(*a*) through 4(*l*), the longitudinal and rotational positional relationships among components of jar tool 1 at selected times during jar operation are best shown. Referring now to FIG. 4(*a*), the relationship among various components is shown prior to the beginning of an impact selection cycle. Jar tool 1 is shown in a closed or retracted position with the inner and outer latch components latched. Jar closing and latching of latch parts occurs when the tension on an operating string is released after a jar has been fired, thereby allowing the jar to set down and allowing the weight of the jar to shorten or close the jar. As best shown in FIG. 4(*a*), prior to the beginning of impact selection, the lobes of inner latch 9 overlap the recesses of outer latch 7 by 10 degrees. The teeth on the lower portion of outer latch 7 engage the teeth on latch sleeve 10 such that the longer teeth on outer latch 7 abut the longer teeth of latch sleeve 10, and the shorter teeth of outer latch 7 are engaged with the shorter teeth of latch sleeve 10. Also, the projecting point of rotational guide 12 is five degrees displaced (counter-clockwise looking upward) with respect to the point of memory positioner 11. The teeth on rotational guide 12 are disengaged from the teeth of second body connector 18. Memory guide 13 and the upward projection of the lower cylindrical portion of main shaft 15 are mated, thereby keeping rotational guide 12 and second body connector 18 disengaged and aligning rotational guide 12 with memory positioner 11. Repositioning unit 14 is disengaged from adjusting unit 16.

Referring to FIG. 4(*b*) the relationships among various components of the jar tool are best shown as the jar begins to open during impact selection. More specifically, as shown in FIG. 4(*b*), the jar is shown after it has opened, that is, lengthened, approximately one and one quarter inches during impact selection. The lobes of inner latch 9 overlap the recesses of outer latch 7 by ten degrees. The teeth of outer latch 7 and the teeth of latch sleeve 10 are engaged the same as in FIG. 4(*a*). The point of rotational guide 12 has been moved clockwise to a position five degrees past the point of memory positioner 11. The teeth of rotational guide 12 and the teeth of second body connector 18 are mated. Memory guide 13 and the upward projection of main shaft 15 are separated, having been disengaged as the jar begins to open during impact selection. Repositioning unit 14 and adjusting unit 16 abut each other and are in sliding engagement.

FIG. 4(*c*) shows the relationships of components when a jar is further opened, that is, lengthened as a result of increasing tension on an operating string during impact selection. FIG. 4(*c*) shows a jar that has been lengthened approximately two and one quarter inches from its closed position, the maximum stroke being four inches in this embodiment used as an example. The lobes of inner latch 9 have increased their overlap with the recesses of outer latch 7 to approximately thirty degrees. The teeth on outer latch 7 and the teeth on latch sleeve 10 have ratcheted so that the large teeth no longer abut each other but the small teeth are still engaged with each other. Rotational guide 12 and memory positioner 11 are is sliding engagement. Rotational guide 12 and second body connector 18 remain engaged. Memory guide 13 and the upward projection of main shaft 15 are further separated. Repositioning unit 14 and adjusting unit 16 are in the same sliding engagement as in FIG. 4(*b*).

Referring now to FIG. 4(*d*), the relationships among various components of the jar tool are shown as the jar is further opened or lengthened to approximately three and one-quarter inches of the maximum stroke of four inches. The lobes of inner latch 9 and the recesses of outer latch 7 rotationally overlap by approximately 60 degrees. The teeth of outer latch 7 and the teeth of latch sleeve 10 have ratcheted so that their respective large teeth have attained a maximum rotational separation from each other corresponding with the maximum attained lengthening of the jar tool. The maximum design stroke of a jar tool need not be attained during any impact selection process. The maximum jar lengthening attained during impact selection is related to the strength and resiliency of the stack of belleville washers. The tension applied through the operating string during impact selection causes compression of the belleville washers between the mandrel hammer and the housing body. The maximum stroke attained depends upon the amount of tensional force applied in the operating string.

As shown in FIG. 4(*d*), rotational guide 12 and memory positioner 11 have increased the engagement along their abutting tapered faces. Rotational guide 12 and second body connector 18 are still engaged. Memory guide 13 and the upward projection of main shaft 15 are increasing separated over that shown in FIG. 4(*c*). Repositioning unit 14 and adjusting unit 16 are in the same sliding engagement as in FIG. 4(*b*).

Referring now to FIG. 4(*e*), the relationship of components of a jar tool as shown as the jar begins to close after the end of an impact selection stroke, that is, as tension is reduced in an operating string to set down on a jar to close or shorten the jar. Inner latch 9 and outer latch 7 are still rotationally engaged by approximately sixty degrees. The rotational engagement is maintained because the relative positions between the teeth of outer latch 7 and the teeth of latch sleeve 10 are maintained in their same maximum attained positions as in the previous step shown in FIG. 4(*d*). Memory positioner 11 and rotational guide 12 have separated. Rotational guide 12 and second body connector 18 are still engaged. Memory guide 13 and the upward projection of main shaft 15 have approached each other to near engagement. Repositioning unit 14 and adjusting unit 16 remain sliding by engaged as in FIG. 4(*b*).

Referring to FIG. 4(*f*), the relationship over jar tool components is shown as the jar is completely closed at the end of an impact selection stroke. The rotational engagement of the lobes of inner latch 9 and the recesses of outer latch 7 are still at the maximum attained. Likewise, the relative rotational position of the teeth of outer latch and the teeth of latch sleeve 10 are still at the maximum attained during impact selection. Rotational guide 12 and memory positioner 11 are repositioned to a five degree offset, that is, to the same position as shown in FIG. 4(*a*). Rotational guide 12 and second body connector 18 are disengaged. Memory guide 13 and the upward projection of main shaft 15 are mated. Repositioning unit 14 and adjusting unit 16 are disengaged sufficiently so that they cannot reengage at the beginning of the impact cycle. The only purpose of repositioning unit 14 and adjusting unit 16 is to reposition the tip of rotational guide 12 clockwise in relation to the tip of memory positioner 11 as the jar tool begins to open during impact selection.

Taken together, FIGS. 4(*a*) through 4(*f*) show an impact selection cycle, that is, the selection of a tensional force that, when reapplied after releasing tension on an operating string, will cause the jar to fire and result in impact of the hammer against the anvil. FIGS. 4(*g*) through 4(*k*) best show the position of various components of the jar tool during an impact stroke. FIG. 4(*g*) shows the relative position of components at the beginning of an impact stroke as tension on an operating string is being increased. In particular, FIG. 4(*g*) shows the relative position of components as the jar is opened one and one-quarter inches during an impact stroke. The only differences between the relative positions of components as the jar is opened at the beginning of an impact stroke and as the jar was completely closed at the end of an impact selection stroke are that rotational guide 12 and second body connector 18 are now mated and memory guide 13 and upward projection of main shaft 15 are now disengaged.

FIG. 4(*h*) shows the relative position of components as a jar is opened approximately two and one-quarter inches. The rotational overlap between the lobes of inner latch 9 and the recesses of outer latch 7 are decreased from approximately sixty degrees to approximately thirty degrees. The teeth of outer latch 7 and the teeth of latch sleeve 10 are ratcheted so that the large teeth of outer latch 7 approach the large teeth of latch sleeve 10. Memory positioner 11 and rotational guide 12 are engaged. Rotational guide 12 and second body connector 18 are engaged. Memory guide 13 and the upward projection of main shaft 15 are further disengaged over that shown in FIG. 4(*g*). Repositioning unit 14 and adjusting unit 16 remain disengaged.

FIG. 4(*i*) shows the relative positions of components of the jar tool as the jar is opened to the maximum achieved during impact selection. The overlap between the lobes of inner latch 9 and the recesses of outer latch 7 decrease to approximately 10 degrees. The large teeth of outer latch 7 and the large teeth of latch sleeve 10 abut. Rotational guide 12 and memory positioner 11 have increased engagement over that shown in FIG. 4(*h*). Rotational guide 12 and second body connector 18 are still engaged. Memory guide 13 and the upward projection of main shaft 15 further disengage over that shown in FIG. 4(*h*). Repositioning unit 14 and adjusting unit 16 remain disengaged.

FIG. 4(*j*) shows the relative positions of components of a jar as the jar is firing, that is, as the lobes of inner latch 9 disengage from the recesses of outer latch 7 before any longitudinal relative motion between outer latch 7 and inner latch 9. The overlap between the lobes of inner latch 9 and the recesses of outer latch 7 is reduced to zero. The large teeth of outer latch 7 abut the large teeth of latch sleeve 10. However, the small teeth of outer latch 7 do not engage the small teeth of latch sleeve 10. The relative positions of memory positioner 11, rotational guide 12, second body connector 18, memory guide 13, upward projection of main shaft 15, repositioning unit 14, and adjusting unit 16 remain as shown in FIG. 4(*i*).

FIG. 4(*k*) shows the relative position of components of a jar after the jar has fired but before it is closed, that is, as the hammer impacts the anvil. Outer latch 7 and inner latch 9 are disengaged both longitudinally and rotationally. The lobes of inner latch 9 no longer align with the recesses of outer latch 7. The teeth of outer latch 7 and the teeth of latch sleeve 10 no longer engage. Memory positioner 11 and rotational guide 12 are at maximum possible engagement. Rotational guide 12 and second body connector 18 are mated, memory guide 13 and the upward projection of main shaft 15 are disengaged, and repositioning unit 14 and adjusting unit 16 remain separated.

FIG. 4(*l*) shows the jar as it closes after impact of the hammer with the anvil but before the lobes of inner latch 9 longitudinally align with the recesses of outer latch 7. The teeth of outer latch 7 are near engagement with the teeth of latch sleeve 10, but they are not yet engaged. Rotational guide 12 and memory positioner 11 are longitudinally separated, but do not rotationally realign, that is, they are in the same rotational position as depicted in FIG. 4(*k*). Rotational guide 12 and second body connector 18 are still mated, memory guide 13 and the upward projection of main shaft 15 are not mated, and repositioning unit 14 and adjusting unit 16 remain separated.

At the conclusion of jar closing after impact of the hammer with the anvil, the lobes of inner latch 9 align longitudinally with the recesses of outer latch 7, resulting in relative positions of components as shown in FIG. 4(*a*).

I claim:

1. A method for providing a jarring force to dislodge objects stuck in well bores, the method comprising the steps of:

(a) connecting a jarring tool between an operating string and an object in a well bore;

(b) selecting a jarring force to be applied to the object, the selected jarring force comprising a combination of tensional force of an operating string and impact force of the jarring tool and ranging continuously within the range of jarring force that can be applied;

(c) setting the selected reference jarring force into a mechanical memory mechanism by progressively engaging a first latch body and a second latch body, the amount of engagement corresponding to the amount of tensional force applied by the operating string;

(d) retaining the reference jarring force in the mechanical memory mechanism during diminution of tensional force applied by the operating string; and (e) initiating an upwardly directed impact force within the jarring tool by increasing tensional force on the operating string to a value greater than the tensional force corresponding with the selected jarring force.

2. A remotely adjustable downhole fishing jar apparatus comprising:

(a) an operating mandrel reciprocatively mounted within a housing body with the mandrel and the housing body adapted to be connected into a well bore operating string, the mandrel and the body forming an impact hammer and an impact anvil for creating an upwardly directed impact force;

(b) an impact release spring adapted to be compressed between the mandrel and the housing body responsive to tension applied to the mandrel by the operating string;

(c) a mechanical memory mechanism for retaining maximum positional engagement achieved between an outer latch body and a relatively rotatable inner latch body during application of selected tension to the mandrel by the operating string; and (d) releasable latching means connected between the mandrel and a bottom portion of the housing body for compressing the release spring until the latching means is released and for releasing engagement between the inner and outer latch bodies during application of tensional force in excess of the selected tensional force, the releasing of engagement causing sudden upward movement of the mandrel and resulting in impact of the hammer with the anvil.

* * * * *